United States Patent [19]

Triguero

[11] Patent Number: 4,879,979

[45] Date of Patent: Nov. 14, 1989

[54] INTAKE AND EXHAUST SYSTEM THROUGH ROTATORY PORTS SHAFT, IN FOUR-STROKE MOTORS

[76] Inventor: Felix O. Triguero, Virgen de la Fuencisla 33, 28027 Madrid, Spain

[21] Appl. No.: 174,700

[22] Filed: Mar. 29, 1988

[30] Foreign Application Priority Data

Mar. 30, 1987 [ES] Spain ..... 8700897

[51] Int. Cl.[4] ..... F01L 7/00

[52] U.S. Cl. ..... 123/190 BB; 123/41.40

[58] Field of Search ..... 123/190 BB, 190 BD, 123/190 DL, 41.40

[56] References Cited

U.S. PATENT DOCUMENTS

| | | | |
|---|---|---|---|
| 2,116,022 | 5/1938 | Gross | 123/190 BB |
| 2,142,325 | 1/1936 | McLaren | 123/190 BB |
| 3,892,220 | 7/1975 | Franz | 123/190 BB |
| 4,016,840 | 4/1977 | Lockshaw | 123/190 BD |
| 4,517,938 | 5/1985 | Krüger | 123/190 BB |

*Primary Examiner*—E. Rollins Cross

*Attorney, Agent, or Firm*—Ladas & Parry

[57] ABSTRACT

An intake and exhaust system through rotatory port shafts, in four-stroke motors, through which are suppressed the camshaft, valve tappets, rocker arms and valves of conventional motors. The system is based on a hollow shaft located in a jacket and the whole assembly is mounted on the cylinder head body of the engine and supported on bearings. The shaft has ports transversely through in communication with the cylinder chambers, quite independently from the combustion order, having the ports shaft lubricating and water-cooling means, being engaged the shaft to a gear driven by the crankshaft of the engine, being 1:4 the ratio of the shaft to the crankshaft rotation.

6 Claims, 3 Drawing Sheets

INTAKE AND EXHAUST SYSTEM THROUGH ROTATORY PORTS SHAFT, IN FOUR-STROKE MOTORS

The invention refers to an intake and exhaust system through rotatory ports shaft in four-stroke motors designed to improve the efficiency and the manufacturing costs of conventional motors.

It is known that four-stroke motors include a cylinder head, some cylinders, a camshaft, a crankshaft, rocker arms and the relative valves, so that these parts and their associated movements drive the engine when this is supplied with the relative fuel.

It is also known that the efficiency of these engines can be improved, since it is far from 100%, and although it can seem utopian to reach that figure, all engines must be manufactured to have high efficiencies.

It is also known that conventional internal combustion engines, because of the aforementioned components, have high manufacturing costs and require continuous maintenance, repairs, inspection and spare parts.

The intake and exhaust system of the present invention has been designed to increase the efficiency of internal combustion engines and to remove most of conventional parts or components, resulting in that the system applicable to four-stroke motors enables the latter to have lower manufacturing costs and minimum maintenance.

More particularly, the system of the invention is based on the use of a rotary shaft driven by the crankshaft, the axle of which are made the ports in an special shape, having direct lubricating means and cooling means. The said shaft is mounted on a sleeve being both disposed on the cylinder head body, communicating with the combustion chambers.

From this system are removed given parts of the conventional engines, like the camshaft, valve tappets, rocker arms, shafts of these, valves and valve springs. In addition, all the reciprocating motion of the unit formed by the said components is suppressed.

This is achieved through a rotatory motion of the ports shaft by which is obtained the desired timing, so that the power required to drive the system of the invention is much lower than to drive the conventional systems, enabling a higher efficiency of the engine.

It is obvious that the manufacturing cost will be much lower than for conventional engines, since many parts of special materials which require high accuracy machining and finishing are suppressed and eliminated.

To have a better understanding of the features of the invention, a description will be given based on the set of drawings appended to the present specification, forming part of the latter, and where, from a general and non-limiting point of view, the following is illustrated:

Figure 1:
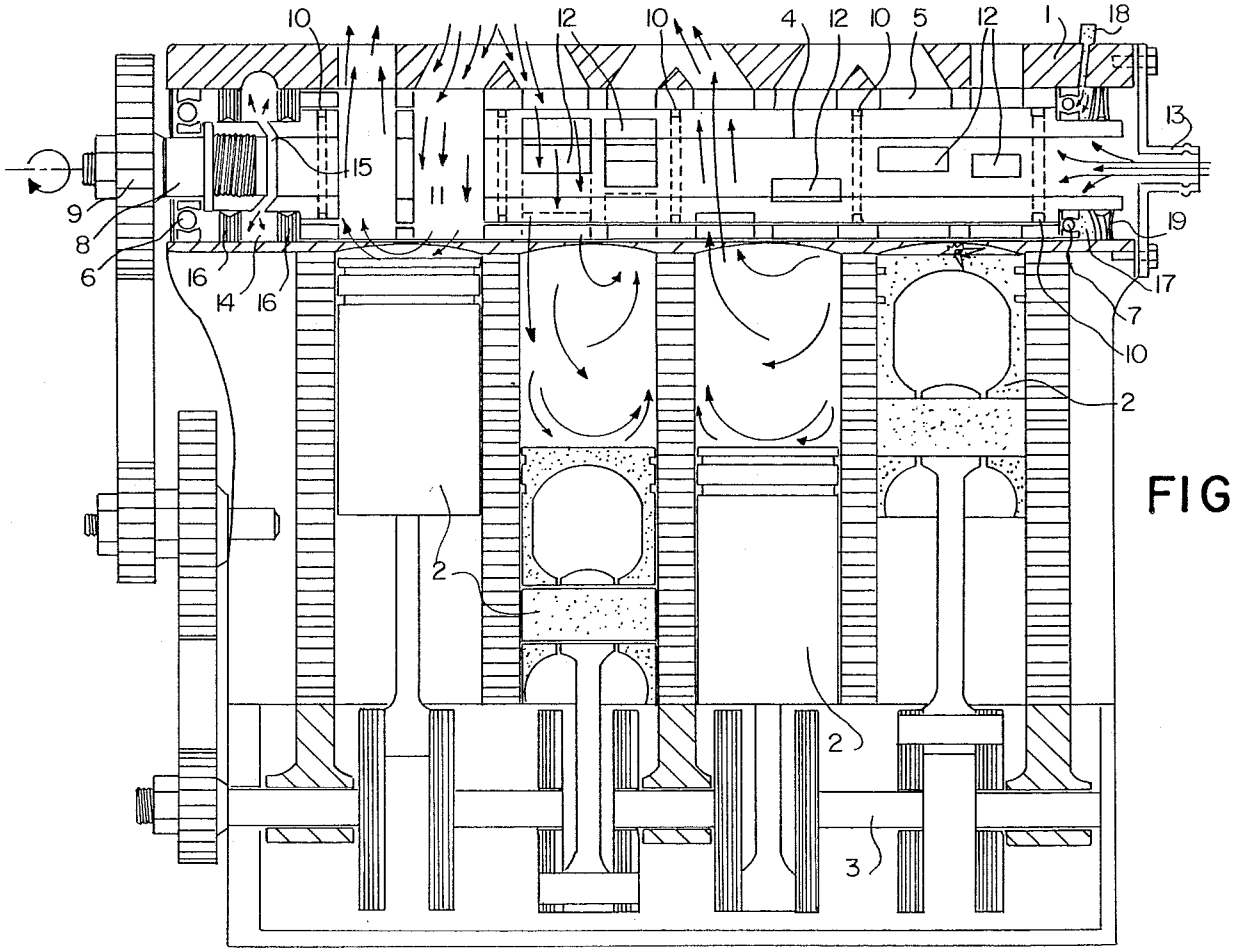
FIG. 1 shows a longitudinal section view of a four-stroke engine provided with the intake and exhaust system of the present invention.

As can be seen in the Figures, and particularly in relation to FIG. 1, illustrated are a cylinder head body (1) of a four-stroke motor with the relative cylinders (2) and crankshaft (3). In the cylinder head body (1) is mounted the intake and exhaust system of the present invention, including a ports shaft (4) located in a jacket (5).

The ports shaft (4) is supported on opposite ends on ball bearings (6) and (7), so to bear most of loads caused by the internal pressure of the cylinders (2), obtaining a soft rotation of the shaft (4) and lower friction and wear between this and the jacket (5).

The ports shaft (4) has an axial extension or hub (8) on which is mounted a gear (9) driven by the crankshaft (3). The speed ratio between the shaft (4) and the crankshaft (3) is ¼, having so a rotation speed relatively low, resulting in a longer life of the system.

On the other hand, so that the cylinders (2) are more independent, the shaft (4) has a set of rings (10) housed and expansion-adjusted inside the jacket (5). The rings (10) are therefore stationary and since the shaft (4) has no side displacement, the wear of the former will be minimum. Likewise, if interferences arose between the ports of the same cylinder, the shaft can be provided with four spacer rings.

The above-mentioned ports, referred as (12), are tubular or rectangular shaped and traverse the shaft (4), so that all the ports (12) remain independent and enable cooling water to go through the shaft (4), as detailed below.

The shaft (4) is hollow and cooled inside through water that enters the nipple (3) provided in the end opposite to the bushing (8). The water goes through the shaft (4) and is expelled at the opposite end to a chamber (14), the water entering the chamber through inclined bores (15) provided in said end. Through those inclined bores (15) the water is expelled to the chamber (14), centrifugally on rotating the shaft (4). The chamber (14) communicates with the cooling water from the cylinder head, resulting in a flow of water that cools the shaft (4) and holds it to the temperature of the cylinder head (1).

On both sides of the chamber (14) are provided seals (16) to prevent the water reaching the chamber (14) from flowing to the shaft (4) and the jacket (5).

The lubrication can be variously carried out. Illustrated in the drawings is an example, consisting in that the cylinder head (1) or jacket (5) is provided with an annular chamber (17) in which ends a trough (18) for pressure oil from the engine. This oil goes along the jacket (5), a felt tube remains continuously oiled, and on rotating the shaft (4) that is always contacting the tube, lubrication is perfect and the oil consumption is low. To carry this type of lubrication out, the jacket (5) can be provided with another longitudinal trough for the casing gas to pass towards the motor intake, causing further lubrication.

The chamber (17) is located between the bearing (7) and the seal (19), as illustrated in FIG. 1.

According to this specification, on rotating the shaft (4) the different ports will coincide with those relative to the cylinders, following the combustion order.

For each half a rotation of the shaft (4) a complete engine cycle of the engine will be carried out, so that the ports (12) will be used again, but in an opposite direction; in the next half a rotation another complete cycle will be carried out, being ¼ the ratio of rotation with regard to the crankshaft.

Figure 3:
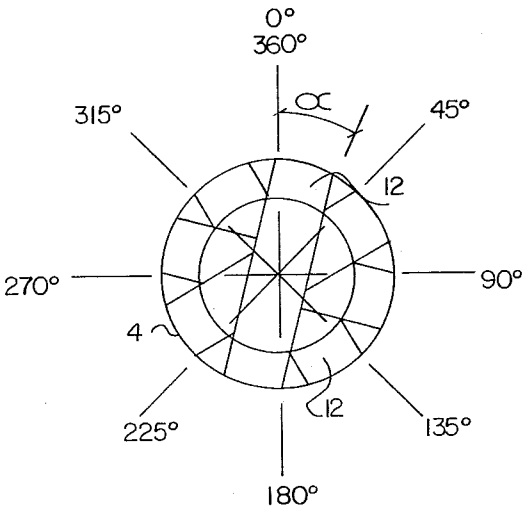
FIG. 3 shows a cross-section view of the ports shaft.

Although the system has been illustrated with a single jacket-ports shaft assembly to perform the intake and exhaust, it is obvious that, if the diameter of the assembly is higher, the width of the ports (12) will increase, since these are marked by the $\alpha$ angle of 30° (FIG. 3). This angle refers to an engine that holds the ports open for 240° of rotation of the crankshaft (3), and so the higher diameter, the higher width.

Figure 2:
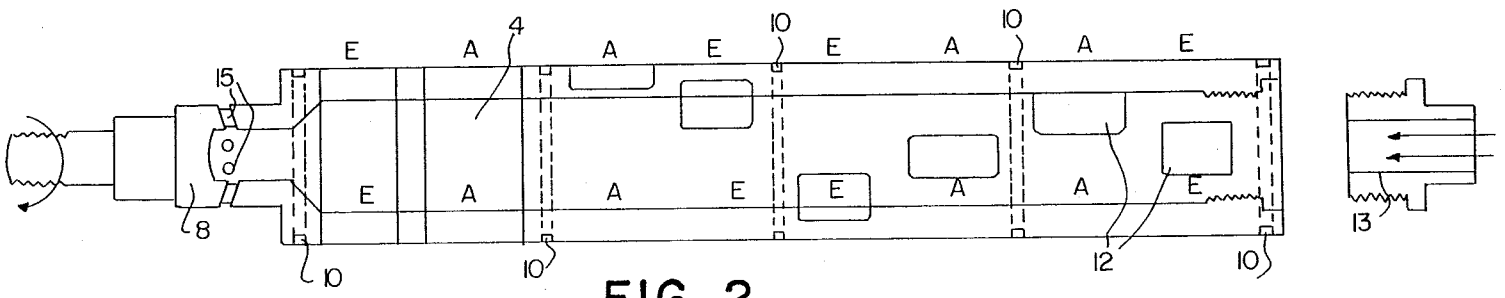
FIG. 2 shows a longitudinal section view of the ports shaft.
Figure 4:
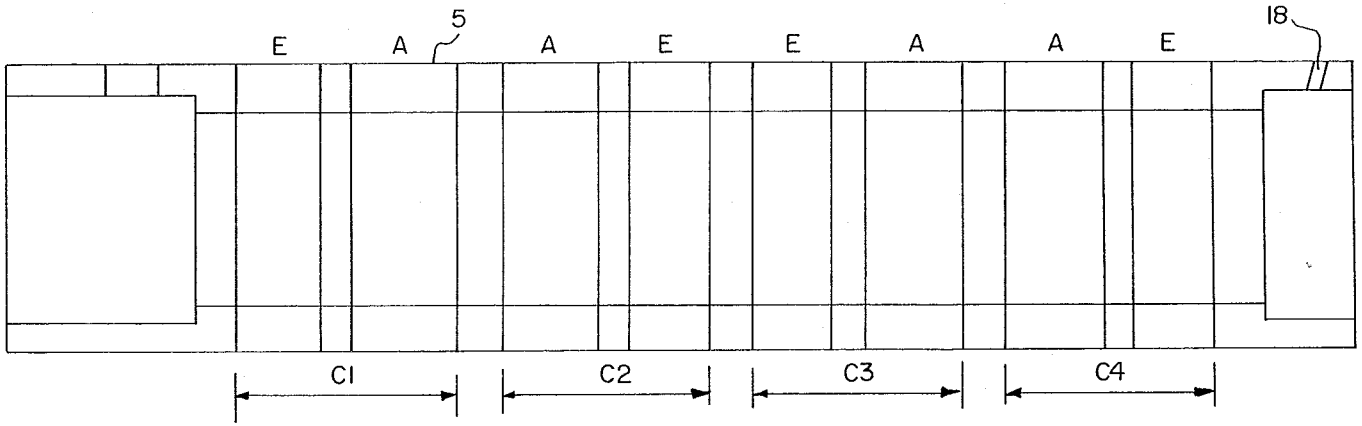
FIG. 4 shows a longitudinal section view of the jacket inside which is disposed the ports shaft.
Figure 5:
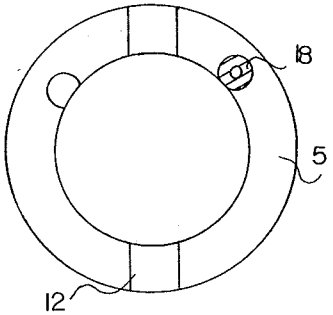
FIG. 5 shows a cross-section view of the jacket illustrated in the preceding Figure.

In FIGS. 2 and 4 the exhaust and intake are respectively referred as E and A, from the cylinders C1, C2, C3 and C4 whose width is shown between the arrows identified as such in FIG. 4. These cylinders are referred to as (2) in FIG. 1.

Finally, the engine may have two jacket-ports shaft assemblies, one for the intake and another for gas exhaust, so that the cost of the engine will increase but which will improve the performance of the engine and establish an absolute independence between both systems, achieving a better sweeping of the gases burned in the cylinders.

To have a better tightness of the assembly, the lower ports (12) of the jacket (5) that communicate with the combustion chamber, have small setting plungers or pistons or any other sectioning system.

What is claimed is:

1. An intake and exhaust system for use in four-stroke motors, said system comprising:

a rotatory ports shaft, said shaft being generally hollow but having ports therethrough, said shaft having a nipple at one end and inclined bores at the other end;

a jacket, said jacket having matching ports through its cross-section, said shaft being rotatably disposed in the jacket;

a gear disposed on an end of the shaft;

ball bearings supporting opposite ends of the shaft;

an annular chamber in fluid communication with a cooling system of said motor, said inclined bores adjoining said annular chamber; and means for introducing water into the nipple so that the water flows through the shaft and then centrifugally enters the annular chamber through the inclined bores.

2. An intake and exhaust system as claimed in claim 1 further comprising a plurality of rings housed and expansion-adjusted between the shaft and the jacket.

3. An intake and exhaust system as claimed in claim 1 wherein the ports are through passages which don't affect the axial passage determining the cavity of the shaft.

4. An intake and exhaust system further comprising small setting plungers disposed upon matching ports of jacket for better tightness of assembly.

5. An intake and exhaust system as claimed in claim 2 wherein the ports are through passages which don't affect the axial passage determining the cavity of the shaft.

6. An intake and exhaust system as claimed in claim 1 wherein the annular chamber is comprised of two seals, each seal firmed disposed on each side of the inclined bore between the shaft and the jacket.

* * * * *